United States Patent [19]

Dodier

[11] Patent Number: 4,572,165

[45] Date of Patent: Feb. 25, 1986

[54] HYDROKINETIC INJECTOR, PARTICULARLY FOR BALNEOTHERAPEUTIC APPLICATIONS

[76] Inventor: Jacques Dodier, 20, Allée Simone Weil, 35100 Bennes, France

[21] Appl. No.: 615,735

[22] Filed: May 31, 1984

[30] Foreign Application Priority Data

Dec. 3, 1982 [FR] France ..... 82 20285

[51] Int. Cl.[4] ..... A61H 9/00

[52] U.S. Cl. ..... 128/24.1; 4/542; 128/66; 128/366; 239/590; 239/597

[58] Field of Search ..... 128/24, 24.1, 66, 365, 128/366, 369, 370; 4/542; 239/101, 428.5, 590, 597, 601

[56] References Cited

U.S. PATENT DOCUMENTS

| | | | |
|---|---|---|---|
| Re. 20,488 | 8/1937 | Zinkil | 239/428.5 UX |
| 3,806,964 | 4/1974 | Vanegas | 4/542 |
| 3,892,363 | 7/1975 | Hilger | 239/590 |
| 4,135,670 | 1/1979 | Sugimoto | 239/428.5 |

FOREIGN PATENT DOCUMENTS

| | | | |
|---|---|---|---|
| 2735578 | 2/1979 | Fed. Rep. of Germany | 128/66 |
| 88192 | 11/1966 | France | 239/597 |
| 2497123 | 7/1982 | France . | |

*Primary Examiner*—Anton O. Oechsle

*Attorney, Agent, or Firm*—Thomas J. Greer, Jr.

[57] ABSTRACT

The present invention relates to a hydrokinetic injector, particularly for balneotherapeutic applications. It comprises a cylindrical pipe (10) of substantially circular internal section, a first end (12) of which is equipped with means of connection to a water supply under a pressure of about $5.10^5$ to about $10^6$Pa; a frustoconical convergent member (18) disposed towards the second end (16) of the said pipe (10) and having a venturi coefficient substantially equal to 1.25; a cylindrical expansion chamber (20) situated immediately downstream of the said frustoconical convergent member (18) and ending in an oblong rectangular window (24) forming a second constriction of the passage section, its venturi coefficient being substantially equal to 2, and a terminal horn (26) delimiting, between the said oblong rectangular window (24) and a distal opening (28), a passage of generally pyramidal shape and of continuously and adjustably variable quadrangular section.

10 Claims, 4 Drawing Figures

HYDROKINETIC INJECTOR, PARTICULARLY FOR BALNEOTHERAPEUTIC APPLICATIONS

The present invention relates to a hydrokinetic injector intended for balneotherapeutic applications, particularly those of the cavitational reflexogenic type.

Cavitational reflexogenic balneotherapy should make it possible to combine the actions of three main neurostimulant agents, namely:

- a thermal agent resulting from the use of hot water,
- a hydromechanical agent, and
- a chemical agent originating from an ionic action of the gas dissolved in a pressurized aerial water jet.

The thermal and hydrokinetic agents give rise to percutaneous neurostimulation, while the chemical agent produces through the dissolved gases (negative singlet oxygen aero-ions) a neurostimulation mainly through the alveolar substratum. These thermal, hydromechanical and chemical neurostimulations effect a regulation of the neurovegetative functions by means of somatic projections with the hypothalamus and the limbic system. A triple action of this kind therefore leads to a harmonization of the psychosomatic functions effecting a neuro-endocrino-sympathetic functional recycling therapy. This therapy nevertheless does not conflict with other treatment of patients.

In order to achieve this result it was necessary to undertake lengthy development of the hydrokinetic injector in order to enable it to produce a pressurized cavitational water flow of quadrangular lamelliform shape, infrasonic shock waves, and negative singlet oxygen ions.

The hydrokinetic injector according to the present invention comprises:

- a cylindrical pipe of substantially circular internal section, a first end of which is equipped with means of connection to a water supply under a pressure of about $5.10^5$ to about $10^6$ Pa;
- a frustoconical convergent member disposed towards the second end of the said pipe and having a venturi coefficient substantially equal to 1.25;
- a cylindrical expansion chamber situated immediately downstream of the said frustoconical convergent member and ending in an oblong rectangular window forming a second constriction of the passage section, its venturi coefficient being substantially equal to 2, and
- an injector head having a lamelliform internal chamber extending from the said oblong rectangular window to a distal opening.

In one variant the injector head is in the form of a terminal horn bounding, between the said oblong rectangular window and a distal opening, a passage of generally pyramidal shape and of continuously and adjustably variable quadrangular section.

Figures 1, 4:
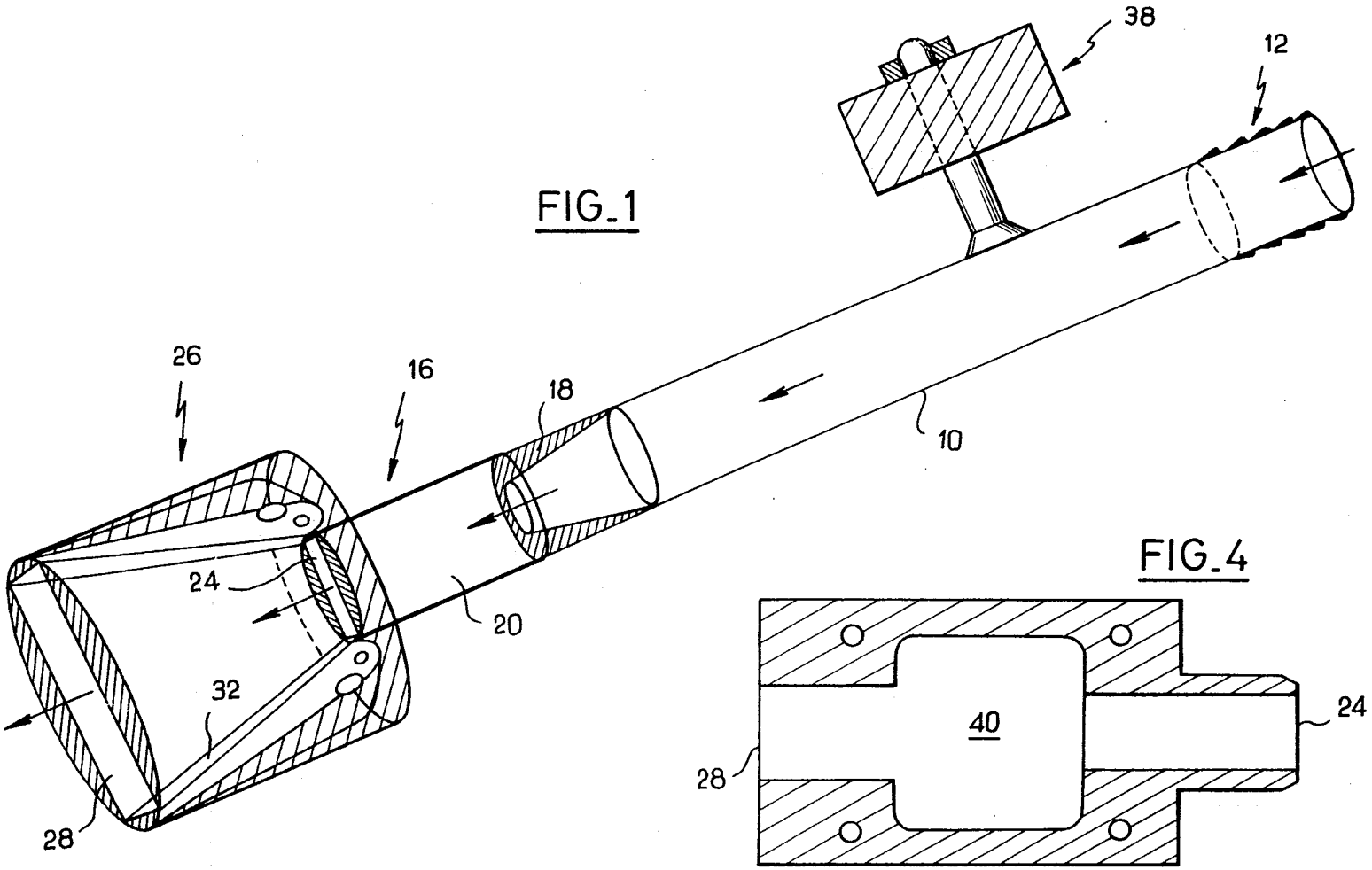
Figure 2:
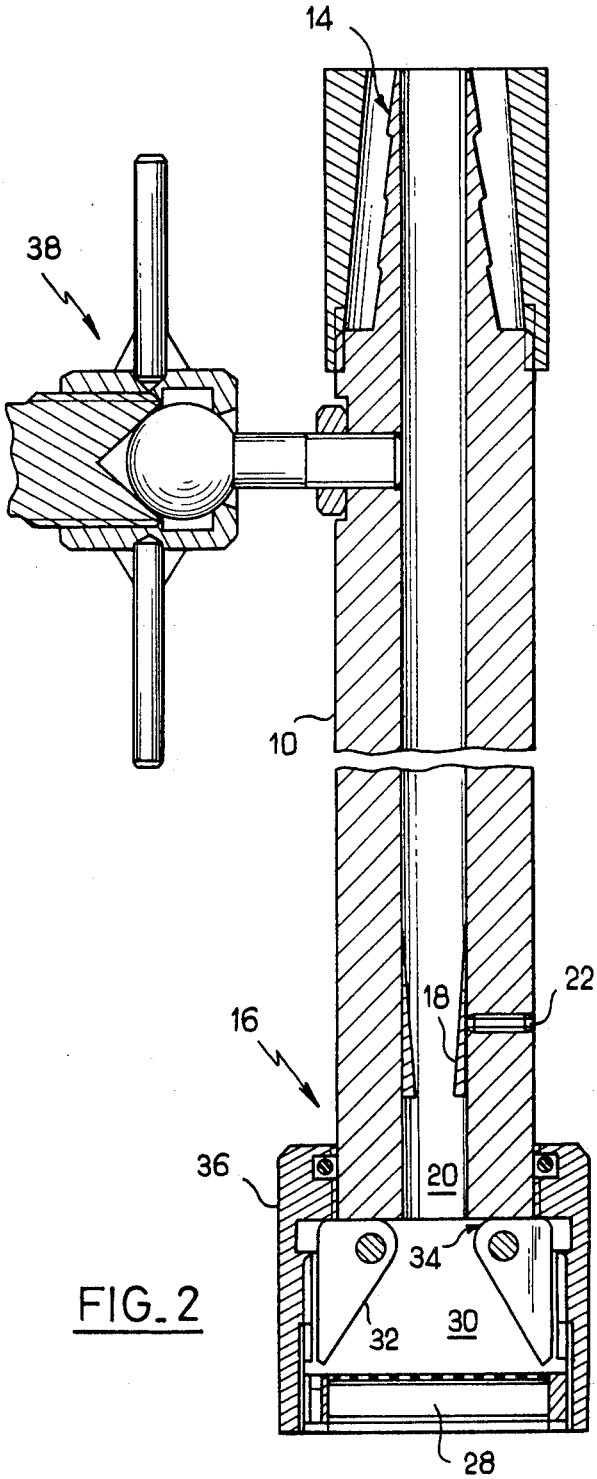
Figure 3:
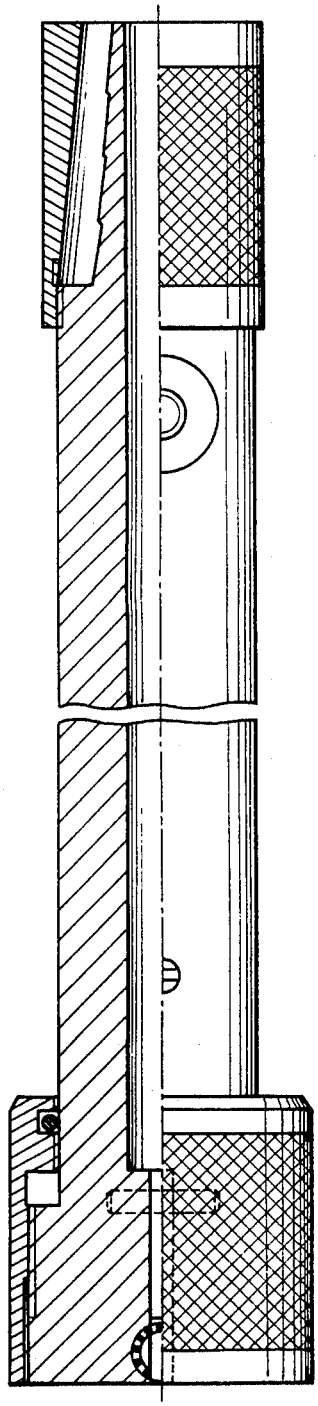

Other characteristics and advantages of the present invention will emerge from perusal of the detailed description given below with particular reference to the accompanying drawings, in which:

FIG. 1 is a view in perspective of the hydrokinetic injector according to the invention, FIG. 2 is a longitudinal section of the hydrokinetic injector through a median plane, FIG. 3 is a longitudinal half-section through a median half-plane perpendicular to the sectional plane of FIG. 2, and FIG. 4 is a section of a special form of construction of the injector head.

In the various accompanying Figures, corresponding elements will be given the same references.

The actual body of the said hydrokinetic injector is composed of a cylindrical pipe 10 of substantially circular internal section. This cylindrical pipe 10 advantageously has a total length of the order of 350 mm and an inside diameter of the order of 15 mm. The first end 12 of this cylindrical pipe is equipped with conventional means for connection to a water installation under a pressure of about $5.10^5$ to about $10^6$ Pa. This first end 12 may for example be in the form of a terminal portion 14 of frustoconical general shape and having a ringed outer surface.

Towards its second end 16 the cylindrical pipe 10 is provided with a frustoconical convergent member 18 having a venturi coefficient $C_V$ substantially equal to 1.25. The venturi coefficient was so selected that:

$$C_V = \left(\frac{\text{area of opening}}{\text{area of neck}}\right)^2 - 1 = 1.25$$

The frustoconical convergent member 18 is advantageously mounted adjustably in the axial position inside the cylindrical pipe 10, near the second end of the latter, at a sufficient distance from that end to form an expansion chamber 20. The frustoconical convergent member 18 may for example be secured in its correct position of use by means of a lock screw 22 passing through a wall of the cylindrical pipe 10.

The frustoconical convergent member 18 may have outlet apertures having different shapes. The outlet aperture may for example have the general shape of an ellipse whose longer axis is perpendicular to the direction of the longer sides of the oblong rectangular window 26. In this case the smaller axis of the ellipse may advantageously have a length of about 6 mm, and the longer axis a length of about 12 mm.

As an alternative, the frustoconical convergent member may have an outlet aperture having a generally circular shape. In this case, the frustoconical convergent member 18 has an angle at the summit of the order of 30° and the opening diameter is of the order of 6 to 9 mm.

The hydrokinetic injector according to the invention therefore also has a cylindrical expansion chamber 20 situated immediately downstream of the said frustoconical convergent member 18. This expansion chamber 20 ends in an oblong rectangular window 24 forming a second constriction of the passage section, with a venturi coefficient $C_V$ substantially equal to 2. The venturi coefficient complies with the same definition given as that above. This cylindrical expansion chamber 20 also serves as a divergent member whose abrupt flare assists the detachment of the fluid and thus gives rise to an unstable water zone promoting the formation of cores containing vapour and gas activating the phenomenon of commencing cavitation. It should be noted that this expansion chamber 20 of constant cylindrical section nevertheless has an adjustable length because of the adjustability of its axial position of the frustoconical convergent member 18 in the cylindrical pipe 10.

In the form of construction of the injector head shown in FIG. 4, the lamelliform internal chamber extends from the oblong rectangular window 24 to the distal opening 28. This lamelliform chamber advantageously has a central portion 40 which is widened relative to the longitudinal dimensions of the window 24 and the opening 28. An injector head of this kind may for example be placed in position on the cylindrical pipe 10 by means of a bayonet type connection.

In the embodiment illustrated in FIGS. 1 to 3 the hydrokinetic injector is finally provided with a terminal horn 26 delimiting, between the oblong rectangular window 24 and a distal opening 28, a passage 30 of generally pyramidal shape and having a quadrangular section which is continuously and adjustably variable.

According to one particular characteristic of the present invention, the expansion chamber 20 ends in two oppositely inclined slopes connected to the longer sides of the oblong rectangular window 24. The terminal horn 26 is advantageously provided with lateral directional flaps 32 adapted to pivot with the aid of a cam surface 34 controlled by a threaded ring 36 mounted on the second end of the cylindrical pipe 10. In practice, the distal opening 28 of the terminal horn 26 has an adjustable length, parallel to the longer sides of the oblong rectangular window 24, of between about 5 and about 50 mm.

The hydrokinetic injector according to the invention is also provided with a support member 38, known per se, permitting adjustable orientation of the injector in all directions in space. With the aid of this support member the hydrokinetic injector according to the invention can be fitted on the edge of a bath or swimming pool. The hydrokinetic injector is placed in position above the surface of the water in such a manner that its longitudinal axis is inclined substantially at 30° relative to the surface of the water. The correct adjustment of the hydrokinetic injector is finally effected in such a manner that the major dimensions of the distal opening 28 of the terminal horn 26 is parallel to the surface of the water in the pool or bath.

The hydrokinetic injector according to the present invention can for example be used under the following conditions in order to achieve a neurostimulation of simultaneously thermal, mechanical and chemical origin.

Use is made for example of a small pool of an individual character, which is mushroom-shaped in section and whose dimensions are 2 m×2 m×1 m×0.60 m.

This pool is in addition equipped with a fixed thermal unit consisting of the following elements:

- a main electric pump of the triple grooved turbine type, with a power of 2.2 kW, controlled by electromechanical relays; this pump operates in a closed circuit with a filter;
- a circulator-heater with pump;
- an immersion thermostat situated in the heater and adjustable to the desired temperature;
- two electric immersion heating elements of 2.2 kW, 220 volts each.

A hydrodynamic bath of 30 to 45 minutes serves as thermal neurostimulant by exciting the cutaneous thermoreceptors, the equipment being set to 34°±1° C.

It should also be observed that, in dependence on the temperature, the percentage of relative humidity of the ambient air is found to be important to the patient's tissue-air interaction, so that a suitable hygrometric state is necessary. Good physiological equilibrium is important and must take into account the physical elements of the atmosphere of the premises where the pool is situated.

A good hygrometric ratio for a person wearing clothes is between 60 and 80% relative humidity with an ambient temperature of 18° to 20° C. For an unclothed person with a dry body a hygrometric state of 80% demands an ambient temperature of 24° C. However, if the person gets out of the hot water, the ambient temperature will advantageously have to be between 24° and 26° C. with a percentage of relative humidity of 30 to 40%. The room must therefore have air conditioning automatically controlled by a hygrometer.

Cavitational reflexogenic balneotherapy can be applied satisfactorily with the aid of the hydrokinetic injector according to the invention specially designed to provide a jet of water at high pressure (about 8 bars) which is adjustable from the filiform to the lamelliform (from 5 mm to 50 mm).

Contrary to what is generally known up to the present time, with the subaquatic jets used in balneotherapy, the outlet of the injector according to the invention is aerial, situated at an average distance of about 4 cm above the surface of the water in the pool and directed towards the subject with an angle of inclination adjustable from 0° to 90° (30°/35° being the most favourable range), thus giving an oblique jet of a length of about 8 cm. Thus a mechanical neurostimulant is placed in position, giving rise to the excitation of the cutaneous baroreceptors and mechanoreceptors.

One of the desired functions of the injector according to the invention is also the generation in the mass of water in the pool of an additional physical cavitation phenomenon on the impact of the terminal trajectory of the aerial jet. This phenomenon gives rise to the appearance of a gas pocket which on each side of the water surface in the pool produces water droplets charged with negative ions. This gas pocket has the effect of producing a gentle and agreeable immersional cutaneous neurostimulation by chimioreception. In addition, above the surface of the water, absorption of negative atmospheric ions by the lungs takes place. Numerous works have described this phenomenon under the name "pulmonary electro-exchange" and show that the negative ions reinforce the natural charge of the endothelial wall and consequently the charges of the red blood corpuscles, but also give rise to a substantial increase of the hemoglobin count and a considerable increase of oxidation processes. When fixed on the red blood corpuscles, the ionized oxygen molecules increase their electric charge and also the electric charge of the colloids suspended in the blood.

Thus, the action of the ions is not limited to a local biological effect, but through the circulation of the blood extends to the entire organism, particularly to the cells of the brain, such as the hypothalamus. The action of the oxygen gives rise to a general stimulation of the cerebral and organic functions. It should be remarked here that this process of oxygenation is sought in therapeutics by the use of certain medicaments.

In practice, it has been possible to use a hydrokinetic injector of this kind in a perfectly satisfactory manner in functional re-education and in traumatology. By way of example, three standard observations, in which the injector according to the invention made it possible to apply therapeutic treatment by cavitational balneotherapy with highly significant results, are reported below.

OBSERVATION 1

Mr. Dominique T., a young, experienced athlete aged 25, suffered from a rupture of the tendon of the lateral peroneus longus of the left foot as the result of an accident. This had been treated by surgery, but no re-education or other physiotherapeutical treatment had been given.

Three years later, the clinical picture is as follows:

acute persistent pain of the tibiotarsal and of the course of the tendon of the lateral peroneus longus on which the operation had been carried out, considerable retraction of the sural triceps, stiffness and restriction of the tibiotarsal, very troublesome functional impotence causing a definite physical handicap for this young athlete and not inconsiderable psychological repercussions.

Twenty sessions of thirty minutes each of cavitational balneotherapy with the injector according to the invention restored normal mobility to this foot, with excellent proprioception—a function which had been lacking for three years.

No active re-education was undertaken because of the painfulness of this ankle, but it is clear that with the athletic temperament of this patient the muscular atrophy will soon disappear.

OBSERVATION 2

Mr. André B., aged 48 , shows considerable after-effects of right-hand scapulohumeral periarthritis dating back more than six months.

The clinical picture shows abduction limited to 30°, with persistent pain.

Twenty sessions of cavitational balneotherapy of 45 minutes restored normal function to this shoulder, without any painful after-effect; the last ten sessions were accompanied by isometric work against muscular atrophy of the shoulder.

An important factor intervenes in this therapy, namely the general physical relaxation of the subject, with the disappearance of the state of anxiety frequently found in patients suffering from scapulohumeral periarthritis.

OBSERVATION 3

Young Michel M., aged 13, undergoing re-education for after-effects of a fracture of the left-hand olecranon, after having had an operation. The "clinical picture showed a re-education stage with blocking of the elbow joint at 45°. After the first session this boy's anxiety quickly disappeared. Relief is rapid with excellent restoration of musculoarticular suppleness starting from the tenth session, during which accompanying active re-education was started. Twenty sessions of 30 minutes of cavitational balneotherapy gave this elbow joint almost normal freedom; the orthopedic surgeon ordered ten further active re-education sessions to complete the result.

It is important to note that this re-education technique is particularly appreciated by children, and prevents all painful stress and the appearance of self-defense postures.

The hydrokinetic injector of the invention can also be used in respiratory re-education. Alveolar stimulations by the (negative singlet oxygen) aero-ions of the gases dissolved by the cavitation of the water bring about better capillarity of the alveoli of the lungs, with a percentage of relative humidity maintained at 70% above the water surface, and immediately give the patient deep, agreeable respiration. Relaxation of the subject and freedom from mechanical stress on the respiratory muscles are rapidly obtained.

Ten sessions of cavitational balneotherapy of a duration of 30 to 45 minutes, depending on the subject, greatly facilitate physiological respiratory education, and in particular the elimination of reflex blockages of the upper air passages and of the bronchial tree.

Finally, the hydrokinetic injector according to the invention leads to remarkable results in psychosomatic re-education. Within the framework of a research hypothesis, a therapeutics applying cavitational reflexogenic balneotherapy for chronic prostatitis has in fact been worked out.

Prostatitis is at the present time the subject of numerous studies, but its scope is very debatable and its prognosis uncertain.

Nevertheless, certain works present chronic prostatitis as resulting from a hypothalamic dysfunction, because disorders of this gland are accompanied by a whole range of diachronic or synchronic disturbances directly linked to the neuroendocrinophysiology of the hypothalamus and neurovegetative system. For example: migraines, lumbar neuralgia, biliary dyskinesia, colopathy, pollakiuria, varicocele, cysts of the epididymis, coldness of the extremities, sterility, disorders of sleep, psychosexual disorders, etc.

20 patients suffering from chronic prostatitis (see Table I) were therefore treated by cavitational reflexogenic balneotherapy comprising 20 sessions of a duration of 45 minutes each, associated with controlled respiratory education. It was found that before the tenth session the majority of the patients noted a substantial improvement of migraines, disorders of sleep, urination disorders, and lumbar neuralgia.

TABLE I

Synthetic clinical table of 20 patients suffering from chronic prostatitis (* > 40%).

| | Frequency in % | | | | |
|---|---|---|---|---|---|
| Disorders | No disorder 1 | Diagnosis made 2 | Heavy medication 3 | Operative action 4 | No answer 5 |
| Gonadial | 20 | 38 | 4 | 38 | 0 |
| Urinary | 23 | 46* | 24 | 7 | 0 |
| Prostatic | 0 | 61* | 36 | 3 | 0 |
| Digestive | 30 | 30 | 25 | 15 | 0 |
| Hepatovesicular | 30 | 30 | 20 | 0 | 20 |
| Circulatory | 38 | 46* | 5 | 1 | 0 |
| Sleep | 46* | 23 | 7 | 0 | 24 |
| Migraines | 38 | 30 | 7 | 0 | 25 |
| Psychological | 23 | 46 | 7 | 0 | 24 |
| Sexual | 20 | 46* | 8 | 0 | 26 |
| Lumborachidian | 1 | 54* | 30 | 15 | 0 |

In the course of this study, the complaints made by the patients were recorded (without suggesting them), but their statements were also checked by careful study of their medical dossiers with the treating physician.

The symptomatology described in our synthetic clinical table was coded as follows:

it was not possible to find any disorder;

a diagnosis was made by the physician;

heavy medication was prescribed by the physician;

operative action was taken by a specialist;

it was not possible to give any answer with certainty.

After 20 sessions of this treatment, in the majority of the patients the prostatic edema had disappeared and a substantial psychosexual improvement was noted.

In addition, two cases of stubborn sterility appear to have been resolved, since the spermograms stabilised between 30 and 50 million and the wives successfully completed normal pregnancies.

These results clearly confirm the neuroendocrinosympathetic action of this hydrodynamic cavitational technique.

The hydrokinetic injector according to the invention therefore permits cavitational reflexogenic balneotheraphy having the advantage of not entailing any iatrogenic risk, particularly in the case of chronic prostatitis, where patients can reduce their polymedication.

Finally, it should be stated that the hydrokinetic injector according to the invention can be used with advantage in different fields of application, such as water purification treatment and pisciculture.

I claim:

1. A hydrokinetic injector intended in particular for balneotherapeutic applications, which comprises:

a cylindrical pipe (10) of substantially circular internal section, a first end (12) of which is equipped with means of connection to a water supply under a pressure of about $5.10^5$ to about $10^6$ Pa;

a frustoconical convergent member (18) disposed towards the second end (16) of the said pipe (10) and having a venturi coefficient substantially equal to 1.25;

a cylindrical expansion chamber (20) situated immediately downstream of the said frustoconical convergent member (18) and ending in an oblong rectangular window (24) forming a second constriction of the passage section, its venturi coefficient being substantially equal to 2, and an injector head having a lamelliform internal chamber extending from the said oblong rectangular window (24) to the distal opening (28), the above defined elements so constructed and arranged relative to each other as to provide a pressurized cavitational water flow of quadrangular, lamelliform shape, infrasonic shock waves, and negative singlet oxygen ions.

2. A hydrokinetic injector as claimed in claim 1, wherein the frustoconical convergent member (18) has an outlet aperture having the general shape of an ellipse whose longer axis is perpendicular to the direction of the longer sides of the oblong rectangular window (24).

3. A hydrokinetic injector as claimed in claim 1, wherein the frustoconical convergent member (18) has an outlet aperture having a generally circular shape, the angle at the summit of the frustoconical convergent member (18) being of the order of 30°.

4. A hydrokinetic injector as claimed in claim 1, wherein the lamelliform chamber has, between the window (24) and the opening (28), a central portion (40) which is widened relative to the longitudinal dimensions of the window (24) and of the opening (28).

5. A hydrokinetic injector as claimed in claim 1, wherein the injector head is in the form of a terminal horn (26) delimiting, between the said oblong rectangular window (24) and a distal opening (28), a passage of generally pyramidal shape and of continuously and adjustably variable quadrangular section.

6. A hydrokinetic injector as claimed in claim 5, wherein the terminal horn (26) comprises two lateral directional flaps (32) each adapted to pivot with the aid of a cam surface (34) controlled by a threaded ring (36) mounted on the second end (16) of the cylindrical pipe (10).

7. A hydrokinetic injector as claimed in claim 1, wherein the frustoconical convergent member (18) is mounted adjustably in respect of its axial position in the cylindrical pipe (10), near the second end (16) of the latter but at a sufficient distance therefrom to form the said expansion chamber (20).

8. A hydrokinetic injector as claimed in claim 7, wherein the expansion chamber (20) is extended by two oppositely inclined slopes connecting to the longer sides of the oblong rectangular window (24).

9. A hydrokinetic injector as claimed in claim 1 wherein the cylindrical pipe (10) is provided with a support member (38) permitting adjustable orientation of the injector in all directions in space.

10. A bath or pool equipped with a hydrokinetic injector as claimed in claim 9, wherein the hydrokinetic injector is placed in position, with the aid of its support, above the surface of the water, the longitudinal axis of the injector being inclined substantially at 30° relative to the surface of the water, and the major dimension of the distal opening (28) being parallel to the surface of the water.

* * * * *

UNITED STATES PATENT AND TRADEMARK OFFICE

CERTIFICATE OF CORRECTION

PATENT NO. : 4,572,165

DATED : February 25, 1986

INVENTOR(S) : JACQUES DODIER

It is certified that error appears in the above-identified patent and that said Letters Patent is hereby corrected as shown below:

The correct address of the inventor, Jacques Dodier, should read: 20, Allee Simone Weil, 35100 Rennes, France, and NOT Bennes, France.

Signed and Sealed this

Twenty-eighth Day of October, 1986

[SEAL]

*Attest:*

DONALD J. QUIGG

*Attesting Officer*

*Commissioner of Patents and Trademarks*